United States Patent [19]

Schwent

[11] Patent Number: 4,896,124

[45] Date of Patent: Jan. 23, 1990

[54] CERAMIC FILTER HAVING INTEGRAL PHASE SHIFTING NETWORK

[75] Inventor: Dale G. Schwent, Hoffman Estates, Ill.

[73] Assignee: Motorola, Inc., Schaumuburg, Ill.

[21] Appl. No.: 264,659

[22] Filed: Oct. 31, 1988

[51] Int. Cl.[4] ..... H01P 1/18; H01P 1/202; H01P 1/213

[52] U.S. Cl. ..... 333/206; 333/134; 333/161; 333/202; 455/78

[58] Field of Search ..... 333/202, 203, 206–212, 333/219, 222–223, 227–228, 230–231, 156–161, 132–135, 138–139, 140; 455/73, 78–83

[56] References Cited

U.S. PATENT DOCUMENTS

| | | | |
|---|---|---|---|
| Re. 32,768 | 10/1988 | D'Avello et al. | 333/202 |
| 4,431,977 | 2/1984 | Sokola et al. | 333/206 |
| 4,716,391 | 12/1987 | Moutrie et al. | 333/206 |
| 4,740,765 | 4/1988 | Ishikawa et al. | 333/270 X |
| 4,742,562 | 5/1988 | Kommrusch | 455/78 |
| 4,799,033 | 1/1989 | Igarishi et al. | 333/134 |

*Primary Examiner*—Marvin L. Nussbaum
*Attorney, Agent, or Firm*—Rolland R. Hackbart

[57] ABSTRACT

An integral phase shifting network of a transmitter filter provides a means to reduce the size and increase the efficiency of an antenna coupling network. The network to shift the phase of the transmitter filter is printed by depositing conductive material directly on a ceramic block using low-loss circuit elements and can be tuned easily by removing conductive material if required in certain applications. By utilizing an integral phase shifting network, either transmit or receive filters having a higly reactive and capacitive out-of-band impedance in the receive or transmit band, respectively, can be connected to a common antenna port without external transmission lines.

9 Claims, 1 Drawing Sheet

CERAMIC FILTER HAVING INTEGRAL PHASE SHIFTING NETWORK

BACKGROUND OF THE INVENTION

The present invention is generally related to ceramic filter and more particularly to an improved ceramic filter having an integral phase shifting network especially adapted for use in antenna duplexers.

Communications equipment that includes both a transmitter and receiver using a common antenna usually requires a network to route transmitted and received signals properly. Received signals coming from the antenna must be directed to the receiver without significant loss to the transmitter. Similarly, transmitted signals from the transmitter must be directed to the antenna without significant loss to the receiver.

In the past, filtering networks such as that described in U.S. Pat. No. 3,728,731 have been used to route the signal appropriately. When the selected filters had highly reactive out-of-passband impedances, transmission lines were often used to connect transmit and receive filters to the antenna (see foe example, U.S. Pat. No. 4,692,726). The lengths of those lines were chosen so that at the junction of the transmit and receive paths, the transmit path would appear as an open circuit to signals in the receive band, and the receive path would appear as an open circuit to signals in the transmit band.

Problems with using this method will arise when the out-of-passband impedance of one of the filters is capacitive at the passband frequencies of the other filter. This situation will require a transmission line for duplexing that is one quarter to one half wavelength long. This rather long transmission line results in two detrimental effects. First, the loss of this transmission line will add to the passband loss of the filter it is connected to, thereby increasing the path loss to the antenna. Secondly, the loss of this transmission line will reduce the out-of-band impedance seen at the junction of the transmit and receive paths, thereby reducing the effectiveness of the duplexing network. In addition to these problems, a long transmission line requires an excessive amount of space to implement, and tuning of the length of line to compensate for unit-to-unit variations in the line itself or the filters out-of-band impedance is difficult.

OBJECTS OF THE INVENTION

Accordingly, it is an object of the present invention to provide a more compact structure for connecting a transmitter and receiver to a common antenna by eliminating the long transmission lines used in prior art coupling networks.

It is another object of this invention is to provide a lower loss, more efficient means of routing signals from the transmitter to the antenna and from the antenna to the receiver by eliminating the loss of long transmission lines used in prior art coupling networks.

It is yet another object of this invention is to provide an easy means of tuning the out-of-passband impedance of a transmitter or receiver.

DESCRIPTION OF THE PREFERRED EMBODIMENT

Figure 1:
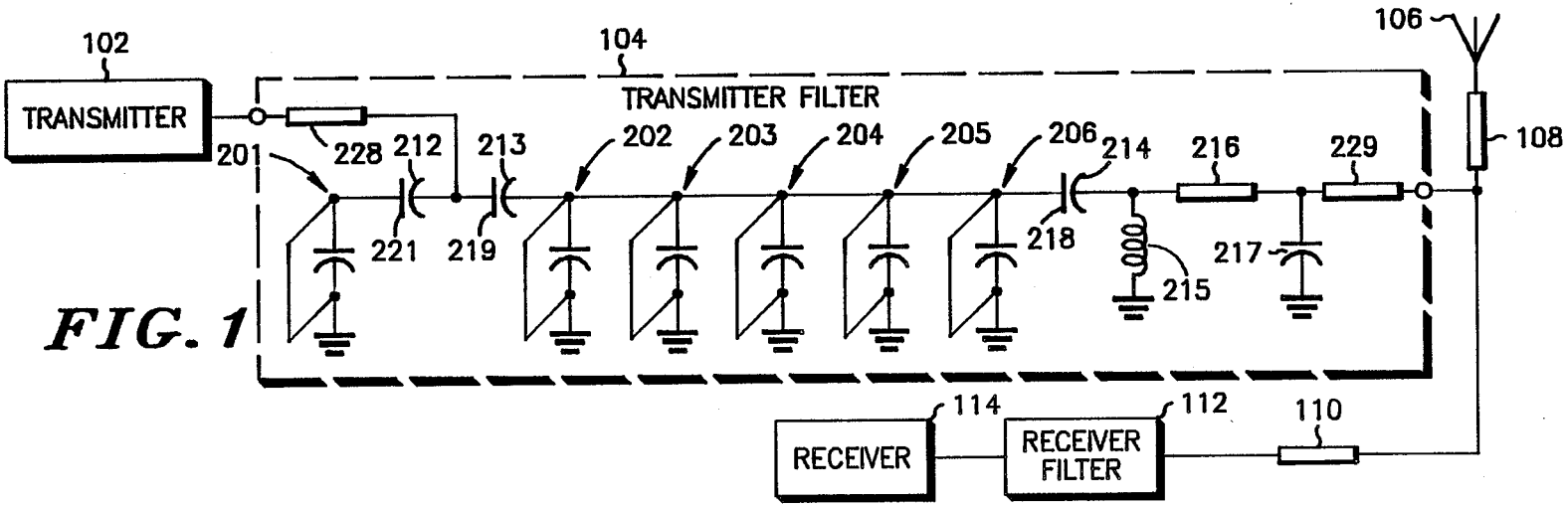
FIG. 1 is a circuit diagram showing the preferred embodiment of the present invention wherein a transmitter and receiver are connected to a common antenna by a transmitter filter including an integral phase shifting network and a receiver filter, respectively.

In FIG. 1, there is illustrated a communication system of the present invention which includes a radio comprised of a transmitter 102 and receiver 114 coupled to an antenna 106 through a duplexing network 104, 108, 110, 112. The duplexing network is made up of a transmit filter 104 incorporating an integral phase shifter 215, 216, 217, receive filter 112, receive duplexing line 110, and antenna transmission line 108. Note that no transmit duplexing line is used in the duplexing network.

The duplexing network passes signals generated in the transmitter 102 through the transmit filter 104, attenuating those outside the transmit frequency band, particularly those in the receive band. Transmit signals emerge from the transmit filter 104 and are coupled to the antenna 106 through the antenna transmission line 108. Through the action of the receive duplexing line 110 and receive filter 112, the receiver path presents an open circuit at transmit band frequencies at the output of transmit filter 104, reflecting transmitter energy away from the receiver. The length of receive line 110 is chosen to rotate the highly reactive output impedance of the receive filter 112 from its characteristic value to the desired open circuit value in the transmit band, minimizing loading on the transmitter.

Received signals captured by the antenna 106 pass through the antenna transmission line 108 and on to the receive path 110, 112, 114. According to the present invention, received signals within the operating frequency band of the receiver are reflected away from the transmit path 102, 104 through the action of the transmit filter 104 and its integral phase shifting network 215, 216, 217. The output impedance of the transmit filter 104 in the receive band is rotated from its characteristic value to an open circuit by the phase shifting elements 215, 216, 217.

In the preferred embodiment of the present invention, the transmit filter 104 is a narrowband, bandpass filter made up of multiple resonator cells 202, 203, 204, 205, 206 on a single ceramic block 230, which are coupled to input and output capacitors 213, 219 and 214, 218, respectively printed on the ceramic block 230. The input transmission line 228 couples the transmitter 102 to capacitor 213, 219. Also coupled to the input line 228 via printed capacitor 212, 221 is a single resonator cell 201 in a bandstop arrangement meant to further reduce the signal level in the receive band. The output capacitor 214, 218 of the filter 104 is connected to the phase shifting network 215, 216, 217 printed on the ceramic block 230. The phase shifting network 215, 216, 217 is coupled by output transmission line 229 to the junction of antenna transmission line 108 and receive duplexing line 110.

Figure 2:
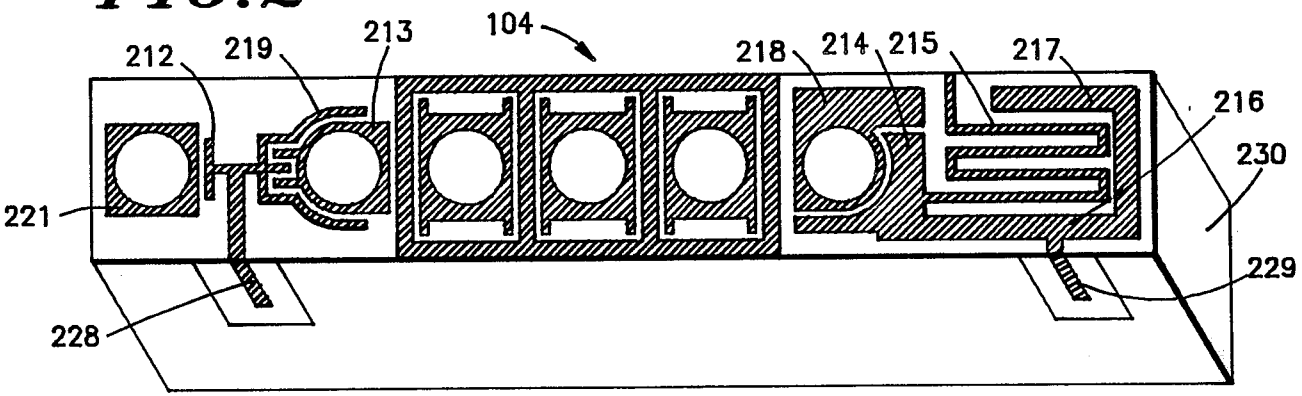
FIG. 2 is a perspective view of the preferred embodiment of the transmitter filter in FIG. 1.

FIG. 2 shows in more detail the phase shifting network 215, 216, 217 at the output of the filter 104. Phase shifting network 215, 216, 217, rotates the highly reactive capacitive output impedance of filter 104 from its characteristic value to the desired open circuit value in the receive band, eliminating the need for an external transmission line as required in the prior art. This feature of the present invention is accomplished with three circuit elements 215, 216 and 217 printed on ceramic block 230 by selectively depositing conductive material thereon. A shunt inductor 215 rotates the output phase from its characteristic capacitive value to an inductive impedance. The transmission line 216 provides some rotation back toward an open circuit, and a physical connection to the shunt capacitor 217 and output transmission line 229. The shunt capacitor 217 provides the rest of the required phase rotation to position the output phase around an optimum open circuit value over the receive band of frequencies. The phase shifter 215, 216, 217 is less glossy than the transmission line it replaces, and is printed directly on the ceramic block 230 reducing the size and complexity of the duplexing network.

If process variations in the filter 104 cause an intolerable variation in the filter's output phase, that phase variation could be easily tuned to the desired value by removing material from the open end of the shunt capacitor 217. With a separate transmission line as in the prior art, the filter and separate transmission line would have to be tuned as a system, thereby increasing the complexity of tuning for phase critical applications.

Input and output transmission lines 228 and 229 extend from the top surface of the ceramic block 230 to its side surface so that filter 104 can be surface mounted on a substrate or circuit board. The ends of lines 228 and 229 on the side surface of ceramic block 230 are isolated from the surrounding conductive material printed on the side surface by portions not printed with conductive material. The bottom and other side surfaces of ceramic block 230 are also printed with conductive material. Holes 201–206 from resonator cells in ceramic block 230 and are also printed with conductive material. The portions of ceramic block 230 and holes 201–206 that are printed with conductive material can be varied depending on the particular application of filter 104.

This invention solves the problems of a long, separate transmission line in prior art radio systems by printing the phase shifting network 215, 216, 217 directly on the ceramic block 230 with low loss, tunable elements to create a more compact, better performing duplexing system.

I claim:

1. A filter for filtering radio signals, comprising:

dielectric means comprised of a dielectric filter having top, bottom and side surfaces, said bottom and side surfaces being substantially covered with a conductive material, a plurality of holes each having surfaces substantially covered by a conductive material and extending from the top surface toward the second surface;

input coupling means coupled to a first hole of said plurality of holes;

first electrode means disposed on the top surface of said dielectric means and coupled to the conductive material of a second of said plurality of holes;

second electrode means disposed on the top surface of said dielectric means at a predetermined distance from said first electrode means for capacitively coupling thereto;

first transmission line means disposed on the top surface of said dielectric means and having a first end coupled to said second electrode means and having a second end coupled to the conductive material of one of said side surfaces, for producing a predetermined inductive impedance;

second transmission line means disposed on the top surface of said dielectric means and having a first end coupled to said second electrode means and having a second end disposed at a predetermined distance from the conductive material of one of said sides, for producing a predetermined capacitive impedance; and output coupling means coupled to the first end of said second transmission line means.

2. The filter according to claim 1, wherein said output coupling means comprises third transmission line means disposed on the top surface of said dielectric means and having a first end coupled to the first end of said second transmission line means and having a portion thereof and a second end disposed on one of said side surfaces.

3. The filter according to claim 1, further including fourth transmission line means disposed on the top surface of said dielectric means between said second electrode means and said second transmission line means, said fourth transmission line means having a first end coupled to said second electrode means and having a second end coupled to the first end of said second transmission line means and said output coupling means.

4. A filter for filtering radio signals, comprising:

a block comprised of a ceramic having top, bottom and side surfaces, said bottom and side surfaces being substantially covered with a conductive material, a plurality of holes each having surfaces substantially covered by a conductive material and extending from the top surface toward the second surface;

input coupling means coupled to a first hole of said plurality of holes;

first electrode means comprised of a conductive material disposed on the top surface of said block and coupled to the conductive material of a second of said plurality of holes;

second electrode means comprised of a conductive material disposed on the top surface of said block at a predetermined distance from said first electrode means for capacitively coupling thereto;

first transmission line means comprised of a conductive material disposed on the top surface of said block and having a first end coupled to said second electrode means and having a second end coupled to the conductive material of one of said side surfaces, for producing a predetermined inductive impedance;

second transmission line means comprised of a conductive material disposed on the top surface of said block and having a first and coupled to said second electrode means and having a second end;

third transmission line means comprised of a conductive material disposed on the top surface of said block and having a first end coupled to the second end of said second transmission line means and having a second end disposed at a predetermined distance from the conductive material of one of said sides, for producing a predetermined capacitive impedance; and output coupling means coupled to the second end of said second transmission line means.

5. The filter according to claim 4, wherein said output coupling means comprises fourth transmission line means comprised of a conductive material disposed on the top surface of said block and having a first end coupled to the second end of said second transmission line means and having a portion thereof and a second end disposed on one of said side surfaces.

6. A duplexing network for coupling first and second signals to an antenna comprising in combination:

an antenna transmission line having a first end coupled to said antenna and having a second end;

first transmission line means having a first end coupled to the first signal and having a second end coupled to the second end of the antenna transmission line;

a filter comprising;

dielectric means comprised of a dielectric filter having top, bottom and side surfaces, said bottom and side surfaces being substantially covered with a conductive material, a plurality of holes each having surfaces substantially covered by a conductive material and extending from the top surface toward the second surface;

input coupling means for coupling the second signal to a first hole of said plurality of holes;

first electrode means disposed on the top surface of said dielectric means and coupled to the conductive material of a second of said plurality of holes;

second electrode means disposed on the top surface of said dielectric means at a predetermined distance from said first electrode means for capacitively coupling thereto;

second transmission line means disposed on the top surface of said dielectric means and having a first end coupled to said second electrode means and having a second end coupled to the conductive material of one of said side surfaces, for producing a predetermined inductive impedance;

third transmission line means disposed on the top surface of said dielectric means and having a first end coupled to said second electrode means and having a second end;

fourth transmission line means disposed on the top surface of said dielectric means and having a first end coupled to the second end of said third transmission line means and having a second end disposed at a predetermined distance from the conductive material of one of said sides, for producing a predetermined capacitive impedance; and output coupling means for coupling the second end of said antenna transmission line to the second end of said third transmission line means.

7. The duplexing network according to claim 6, wherein said output coupling means comprises fifth transmission line means disposed on the top surface of said dielectric means and having a first end coupled to the second end of said second transmission line means and having a portion thereof and a second end disposed on one of said side surfaces.

8. A radio comprising in combination:

an antenna;

an antenna transmission line having a first end coupled to said antenna and having a second end;

a receiver having an input;

a receive transmission line having a first end coupled to the input of the receiver and having a second end coupled to the second end of the antenna transmission line;

a transmitter having an output;

a transmit filter comprising;

dielectric means comprised of a dielectric filter having top, bottom and side surfaces, said bottom and side surfaces being substantially covered with a conductive material, a plurality of holes each having surfaces substantially covered by a conductive material and extending from the top surface toward the second surface;

input coupling means for coupling the output of said transmitter to a first hole of said plurality of holes;

first electrode means disposed on the top surface of said dielectric means and coupled to the conductive material of a second of said plurality of holes;

second electrode means disposed on the top surface of said dielectric means at a predetermined distance from said first electrode means for capacitively coupling thereto;

first transmission line means disposed on the top surface of said dielectric means and having a first end coupled to said second electrode means and having a second end coupled to the conductive material of one of said side surfaces, for producing a predetermined inductive impedance;

second transmission line means disposed on the top surface of said dielectric means and having a first end coupled to said second electrode means and having a second end;

third transmission line means disposed on the top surface of said dielectric means and having a first end coupled to the second end of said second transmission line means and having a second end disposed at a predetermined distance from the conductive material of one of said sides, for producing a predetermined capacitive impedance; and output coupling means for coupling the second end of said antenna transmission line to the second end of said second transmission line means.

9. The radio according to claim 8, wherein said output coupling means comprises fourth transmission line means disposed on the top surface of said dielectric means and having a first end coupled to the second end of said first transmission line means and having a portion thereof and a second end disposed on one of said side surfaces.

* * * * *